US011473389B2

(12) United States Patent
Petegem

(10) Patent No.: US 11,473,389 B2
(45) Date of Patent: Oct. 18, 2022

(54) TUMBLER RING LEDGE AND PLUG SYSTEM

(71) Applicant: Ronald van Petegem, Montgomery, TX (US)

(72) Inventor: Ronald van Petegem, Montgomery, TX (US)

( * ) Notice: Subject to any disclaimer, the term of this patent is extended or adjusted under 35 U.S.C. 154(b) by 449 days.

(21) Appl. No.: 16/355,728

(22) Filed: Mar. 16, 2019

(65) Prior Publication Data

US 2019/0368303 A1 Dec. 5, 2019

Related U.S. Application Data

(60) Provisional application No. 62/679,776, filed on Jun. 2, 2018.

(51) Int. Cl.

| | |
|---|---|
| ***E21B 33/12*** | (2006.01) |
| ***E21B 23/01*** | (2006.01) |
| ***E21B 29/02*** | (2006.01) |
| ***E21B 33/128*** | (2006.01) |
| ***E21B 23/03*** | (2006.01) |

(52) U.S. Cl.

CPC ..... *E21B 33/12* (2013.01); *E21B 23/01* (2013.01); *E21B 23/03* (2013.01); *E21B 29/02* (2013.01); *E21B 33/128* (2013.01)

(58) Field of Classification Search

CPC ..... E21B 33/12; E21B 33/128; E21B 33/10; E21B 23/01; E21B 23/03; E21B 23/12; E21B 29/02

See application file for complete search history.

(56) References Cited

U.S. PATENT DOCUMENTS

| | | | |
|---|---|---|---|
| 3,266,575 A | 8/1966 | Owen | |
| 3,282,346 A | 11/1966 | Claycomb | |
| 3,306,366 A | 2/1967 | Muse | |
| 3,818,987 A | 6/1974 | Ellis | |

(Continued)

FOREIGN PATENT DOCUMENTS

| | | | |
|---|---|---|---|
| GB | 2580432 A * | 7/2021 | ..... E21B 23/01 |
| WO | 2016032761 A1 | 3/2016 | |

OTHER PUBLICATIONS

Jul. 22, 2021 Applicant Arguments in EPO19731050.1 [dated 2021.*

(Continued)

*Primary Examiner* — George S Gray
(74) *Attorney, Agent, or Firm* — Compton & Associates PLLC; Matthew Compton

(57) ABSTRACT

A tumbler ring apparatus, method, and system for deployment in a subterranean well at a setting location. The tumbler ring may have a generally oval shape with a major axis and a minor axis. The major axis defining a major diameter of the ring and the minor axis defining a minor diameter of the ring. The major diameter of the ring being larger than the inner diameter of the subterranean well at the setting location, and the minor diameter of the ring being smaller than the inner diameter of the subterranean well at the setting location. The ring is further configured to substantially deform to the inner circumference of the subterranean well at the setting location when tumbled by reducing the major diameter of the ring to cause the ring to generally take the shape of the inner circumference of the subterranean well.

43 Claims, 9 Drawing Sheets

(56) References Cited

U.S. PATENT DOCUMENTS

| | | | | |
|---|---|---|---|---|
| 4,381,822 | A * | 5/1983 | Fisher, Jr. | E21B 34/06 166/326 |
| 4,479,548 | A | 10/1984 | Gilbert | |
| 4,577,686 | A * | 3/1986 | Milberger | E21B 33/043 166/208 |
| 6,796,376 | B2 | 9/2004 | Frazier | |
| 6,986,390 | B2 | 1/2006 | Doane et al. | |
| 7,353,879 | B2 | 4/2008 | Todd et al. | |
| 8,127,856 | B1 | 4/2012 | Nish et al. | |
| 8,196,515 | B2 | 6/2012 | Streibich et al. | |
| 9,695,663 | B2 | 7/2017 | Hiorth | |
| 10,273,769 | B2 | 4/2019 | Crow | |
| 10,287,835 | B2 | 5/2019 | Crow | |
| 10,329,862 | B2 | 6/2019 | Crow | |
| 2003/0047880 | A1 | 3/2003 | Ross | |
| 2005/0205266 | A1 | 9/2005 | Todd et al. | |
| 2007/0039160 | A1 | 2/2007 | Turley et al. | |
| 2010/0276159 | A1 | 11/2010 | Mailand et al. | |
| 2011/0048743 | A1 | 3/2011 | Stafford et al. | |
| 2013/0306330 | A1 | 11/2013 | Bishop et al. | |
| 2018/0266205 | A1 | 9/2018 | Martin et al. | |

OTHER PUBLICATIONS

EPO Office Action dated Sep. 28, 2021 in European Patent Application No. 19731050.1.

PO Response and amended claims dated Feb. 7, 2022 to EPO Office Action dated Sep. 28, 2021 in European Patent Application No. 19731050.1.

* cited by examiner

Fig. 7
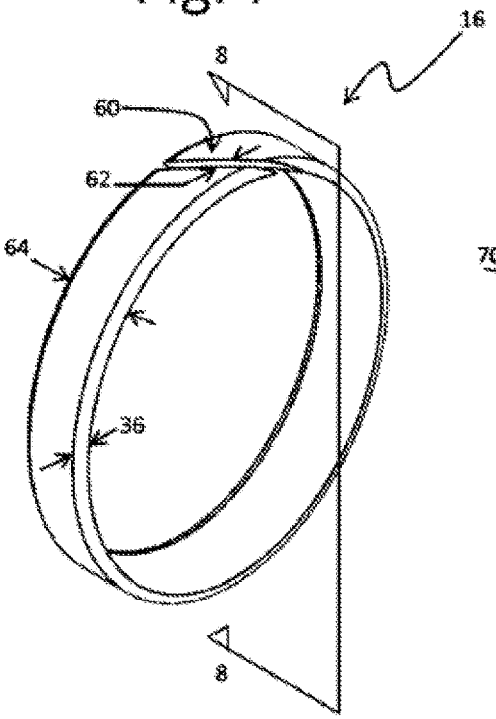
Fig. 8
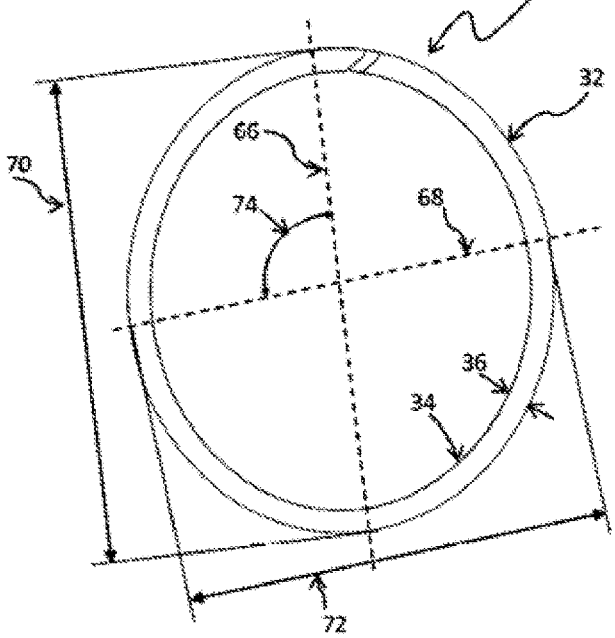
Fig. 13
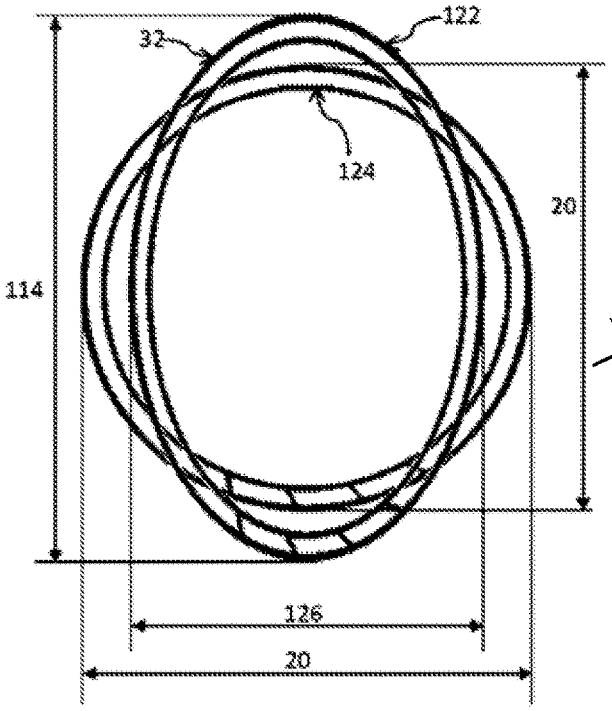
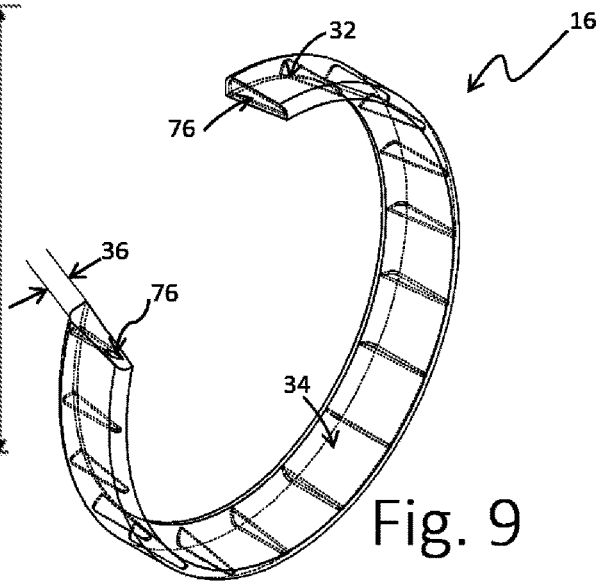
Fig. 9

TUMBLER RING LEDGE AND PLUG SYSTEM

RELATED APPLICATIONS

This patent application claims priority to U.S. Provisional Application Ser. No. 62/679,776, filed 2018 Jun. 2, which is hereby incorporated by reference.

FIELD OF INVENTION

The invention relates to what is generally known as a completion, workover, stimulation, or intervention of subterranean wells. Specifically, this invention relates to flow control devices, plugs and packers, and installing/removing flow control devices, plugs and packers from a subterranean wellbore.

BACKGROUND

Packers, plugs, and flow control devices such as landing nipples are used to support well stimulation, well completion, well workover, and well intervention operations. In these exemplary applications, a plug performs three actions: (1) grip; (2) seal; and (3) lock. To accomplish these actions, plugs may include: (1) one or more sealing elements; (2) one or more slips for gripping the wall of a tubular or pipe; (3) one or more cones to force the slips outwards towards the tubular wall; (4) a central mandrel or body; and (5) a locking device or system that interacts with the cones and mandrel to prevent the pine or packer from upsetting. In other words, prior art plugs require a number of parts and volume of material in order to operate. Furthermore, the largest external diameter of the plug assembly must be smaller than the internal diameter of the tubular at the target setting location to allow the plug to traverse through the wellbore and reach the setting location. Once in place, prior art plugs may be removed from the wellbore by milling grinding or degrading, or first unlocking the device and then removing it from the wellbore, or in some cases be pushed down the wellbore. All of this requires time, and effort, and can further complicate the operation.

Accordingly, there is a need for a ring or plug that seals and/or grips against the well bore wall without requiring a locking system, mandrel, cone, slip, and/or separate sealing system to seal and/or grip again the wellbore wall.

BRIEF DESCRIPTION

Embodiments of the present invention include a tumbler ring that seals and/or grips against the wellbore wall without requiring a locking system, mandrel, cone, slip or separate sealing system. This reduces the volume of material required, and also reduces the number of parts that have to be installed or removed.

Embodiments of the invention allow for an apparatus, referred to as a tumbler ring or ring, to be installed into a well tubular or open hole at a setting location. In one embodiment the tumbler ring consist of a single oval, ellipse, or egg shaped ring that after tumbling or rotating is set in the well tubular or open hole. The tumbler ring creates a ledge in the wellbore that may be used as seat for a ball or dart to create a diversion device, or to be used as a ledge to support the installation of downhole tools such as a pressure gauge.

Embodiments of the tumbler ring have a generally oval shape with a major axis and a minor axis. The major axis defines a major diameter of the tumbler ring and the minor axis defines a minor diameter of the tumbler ring. The major diameter of the tumbler ring is larger than the inner diameter of the subterranean well at the setting location, and the minor diameter of the tumbler ring is smaller than the inner diameter of the subterranean well at the setting location. The tumbler ring is further configured to interact with, and substantially deform to, the inner circumference of the subterranean well at the setting location by reducing the major diameter and increasing the minor diameter of the tumbler ring thereby causing the tumbler ring to generally take the shape of the inner circumference of the subterranean well at the setting location. This interaction secures the tumbler ring in the subterranean well at the setting location.

In one embodiment the total circumference of the tumbler ring is equal to larger than the inner circumference at the target setting location of the wellbore in which it is to be deployed. In other embodiments, the total circumference of the tumbler ring maybe less than the inner circumference at the target setting location of the wellbore in which it is to be deployed. To allow installation, the tumbler ring is typically run on a setting tool system, where the tumbler ring is connected to the setting tool via a deployment device or system. The tumbler ring is positioned in a first orientation on the deployment device such that it is angled to the inner diameter of the wellbore and can traverse the wellbore. The system is then deployed into a wellbore and after the setting location is reached, the setting tool is activated causing the tumbler ring to rotate perpendicular to the wellbore diameter at the setting location and engage the inner circumference of the wellbore at the setting location. One or more portions of the outer wall of the tumbler ring will then interact with the inner wellbore wall. The interaction with the wellbore circumference causes the major diameter of the tumbler ring to be pushed inwards and the minor diameter to be pushed outwards. The tumbling will continue until the tumbler ring generally takes the shape of the inner circumference of the wellbore at the setting location. After setting, the outer perimeter of the tumbler ring will be mostly conforming and mostly concentric with the inner circumference of the wellbore at the setting location creating a grip and/or seal with the outer circumference of the tumbler ring.

Those skilled in the art will appreciate that seal or sealing means that if a ball, dart, or plug is attached to the tumbler ring, and pressure is applied on top of the tumbler ring with the ball, plug, or dart, the leak rate is sufficiently low to allow fluids to be diverted into the formation above the tumbler ring. In other words, a 100% seal can sometimes be accomplished, but is not required to provide full functionality.

An advantage of the proposed method and apparatus is that it may be a single part that provides gripping and/or sealing. It is through the interaction with the inner circumference of the wellbore at the setting location that the tumbler ring is compressed across its major diameter to substantially deform to the inner circumference of the wellbore. Although the tumbler ring does not require additional parts to achieve its functionality, items such as a dart, plug, or ball may be incorporated with or after the installation, thereby interacting with the tumbler ring, creating additional functionality and possibly enhancing its grip and/or seal with the tubular wall. Thus, the tumbler ring may have profiles, shoulders or contours to interact with another device such as but not limited to: a ball, a dart, or a seal assembly.

The tumbler ring may also have its outer surface modified to enhance gripping and/or sealing to the wellbore walls.

Such enhancements include but are not limited to: (1) particles such as silicon carbide (SiC) attached to the outer surface, which are harder than the material of the wellbore wall and/or the tumbler ring. Attachment of these particles can be accomplished using an epoxy or resin or other methods including but not limited to: (1) sintering; (2) profiles machined or attached to the outer surface (the profiles may be treated to increase their hardness); and (3) sealing systems such as an elastomers or thermo plastics bonded to the tumbler ring. Those skilled in the art will appreciate that many different gripping and sealing systems or components exist and that these can be used on their own or in combination with each other.

To enhance its ductility, ease of tumbling, or other properties, the tumbler ring may also have at least one slot, hole, or gap in its wall and/or be shaped as an oval C-Ring. Those skilled in the art of advanced manufacturing technologies, such as additive manufacturing (including 3D printing), will appreciate that these slots or holes may either be through the wall and/or embedded within the wall. These pockets may also be partially or wholly filled with, but not limited to: air, gas, vacuum, elastomers, thermo plastics, tracer chemicals, or combinations thereof.

The tumbler ring and its other components can be made from a variety of materials, including but not limited to: alloy steel, stainless steel, cast iron, duplex steel, elastomers, thermo plastics, composites, degradable materials, dissolvable material, aluminum, or combinations thereof. As discussed, another device or system such as a ball or dart can be installed to interact with the tumbler ring to collectively form a plug and/or to further enhance conformance of the tumbler ring with the inner circumference of the wellbore and/or enhance the gripping/sealing capabilities or other properties, performance, or features. These other devices or systems may be installed during, with, or after the installation of the tumbler ring. Some of these devices or systems can be used to enhance the ease of installation of the tumbler ring.

Other enhancements to the tumbler ring may include but are not limited to installing more than one tumbler ring at a setting location such that when the first tumbler ring is set inside the wellbore, additional tumbler rings can be set and interact with the first tumbler ring. Embodiments of the tumbler ring may be coiled and have spring like properties. Other embodiments of the tumbler ring may consist of multiple stacked rings. Other embodiments of the tumbler ring may be installed within or on top of a profile that is pre installed in a wellbore tubular or device. This profile may be a recess or a protrusion. Those skilled in the art will appreciate that such profile can enhance depth correlation or provide additional support for the tumbler ring.

The specification provides an embodiment of an apparatus configured to be deployed in a subterranean well at a setting location having an inner diameter and an inner circumference. The apparatus includes a ring having an outer circumference, an inner circumference, and a wall having a wall thickness. In one embodiment the ring has a generally oval shape with a major axis and a minor axis. The major axis defines a major diameter of the ring and the minor axis defines a minor diameter of the ring. The major diameter of the ring is larger than the inner diameter of the subterranean well at the setting location, and the minor diameter of the ring is smaller than the inner diameter of the subterranean well at the setting location. The ring is further configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location. Those skilled in the art will appreciate that in some cases and due to the high loads that the ring is subjected to, the ring may Move or slip relative to the setting location during use. This movement or slipping is expected and normally not more than a few inches.

In this embodiment, the major axis of the ring may be generally perpendicular to the minor axis of the ring. The outer circumference of the ring may be equal to or larger than the inner circumference of the subterranean well at the setting location before substantially deforming to the inner circumference of the subterranean well. The wall of the ring may include at least one slot, hole, or gap. The at least one slot, hole, or gap may extend through the entire wall thickness of the ring. The wall of the ring may include at least one void contained within the wall thickness of the ring that does not extend to the outer circumference of the ring or the inner circumference of the ring. The outer circumference of the ring may include particles that engage the inner circumference of the subterranean well at the setting location. The ring may be made of a material that galvanically corrodes at a subterranean well, or of a material that disintegrates as a result of an interaction with a fluid in a subterranean well.

According to another embodiment, the specification provides an apparatus configured to be deployed in a subterranean well at a setting location having an inner diameter and an inner circumference. The apparatus includes a ring having an outer circumference, an inner circumference, a wall having a wall thickness, a major axis, and a minor axis. The major axis defines a major diameter of the ring and the minor axis defines a minor diameter of the ring. The major diameter of the ring is larger than the inner diameter of the subterranean well at the setting location, and the minor diameter of the ring is smaller than the inner diameter of the subterranean well at the setting location. The ring is configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location.

In this embodiment, the major axis of the ring may be generally perpendicular to the minor axis of the ring, and the ring may have a generally oval shape having a substantially constant eccentricity. The outer circumference of the ring may be equal to or larger than the inner circumference of the subterranean well at the setting location before substantially deforming to the inner circumference of the subterranean well. The wall of the ring may include at least one slot, hole, or gap. The at least one slot, hole, or gap may extend through the entire wall thickness of the ring. The outer circumference of the ring may include a wave shape. The ring may also be generally in the shape of an egg having a first focus and a second focus, with a sum of the distance from the first focus to a vertex and a multiple of the distance from the second focus to the vertex remains generally constant for any point on the outer circumference of the ring. The wall of the ring may include at least one void contained within the wall thickness of the ring that does not extend to the outer circumference of the ring or the inner circumference of the ring. The outer circumference of the ring may include particles that engage the inner circumference of the subterranean well at the setting location. The ring may be made of a material that galvanically corrodes in a subterranean well, or made of a material that disintegrates as a result of an interaction with a fluid in a subterranean well.

According to another embodiment, the specification provides a method of installing an apparatus in a subterranean well. The method includes positioning a ring on a deployment device, the ring having an outer circumference, an inner circumference, a wall having a wall thickness, a major axis and a minor axis. The major axis defines a major diameter of the ring and the minor axis defines a minor diameter of the ring. The method limber includes inserting the deployment device and the ring into the subterranean well, the ring positioned on the deployment device in a first orientation that allows the ring and the deployment device to traverse the subterranean well. The method also includes delivering the deployment device and the ring to a setting location in the subterranean yell. The major diameter of the ring is larger than the inner diameter of the subterranean well at the setting location, and the minor diameter of the ring is smaller than the inner diameter of the subterranean well at the setting location. The method further includes activating the deployment device to position the ring in a second orientation that results in the major diameter of the ring engaging the inner circumference of the subterranean well at the setting location and thereby reducing the major diameter of the ring to cause the ring to generally take the shape of the inner circumference of the subterranean well at the setting location to secure the ring in the subterranean well at the setting location. The method may also include providing an indicator in the deployment device that indicates a level of engagement between the outer circumference of the ring and the inner circumference of the subterranean well at the setting location. The indicator may indicate a degree of rotation of the ring from the first orientation to the second orientation.

The method may further include removing the ring from the subterranean well by positioning a removing device in the subterranean well. This method would include engaging the ring in the second orientation with the removing device. This method would further include activating the removing device to position the ring from the second orientation to the first orientation thereby causing the major diameter of the ring to disengage the inner circumference of the subterranean well at the setting location.

According to another embodiment, the specification provides a subterranean well assembly. The subterranean well having an inner diameter at a setting location and an inner circumference at the setting location. The subterranean well assembly including a ring having an outer circumference, an inner circumference, and a wall having a wall thickness. The ring may have a generally oval shape with a major axis and a minor axis. The major axis defines a major diameter of the ring and the minor axis defines a minor diameter of the ring. The major diameter of the ring is larger than the inner diameter of the subterranean well at the setting location, and the minor diameter of the ring is smaller than the inner diameter of the subterranean well at the setting location. The ring is further configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location.

In this embodiment, the inner diameter and the inner circumference of the subterranean well at the setting location may be defined by casing. Moreover, at least two points located on the inner circumference of the subterranean well at the setting location may be at different distances from a center of the subterranean well. The major axis of the ring may be generally perpendicular to the minor axis of the ring. The outer circumference of the ring may be equal to or larger than the inner circumference of the subterranean well at the setting location before substantially deforming to the inner circumference of the subterranean well. The wall of the ring may include at least one slot, hole, or gap. The at least one slot, hole, or gap may extend through the entire wall thickness of the ring. The ring may include at least one void contained within the wall thickness of the ring that does not extend to the outer circumference of the ring or the inner circumference of the ring. The outer circumference of the ring may include particles that engage the inner circumference of the subterranean well at the setting location. The ring may be made of a material that galvanically corrodes in a subterranean well, or made of a material that disintegrates as a result of an interaction with a fluid in a subterranean well.

The subterranean well assembly may also include a second inner diameter at a second location, with the second location being adjacent to the setting location. The second inner diameter at the second location is smaller than the inner diameter at the setting location thereby forming a shoulder in the subterranean well at the transition from the second location to the setting location. A portion of the wall thickness of the ring engages the shoulder to further secure the ring in the subterranean well.

DRAWINGS

The drawings accompanying and forming part of this specification are included to depict certain aspects of embodiments of the invention. A clearer impression of embodiments of the invention, and of the components and operation of systems provided with embodiments of the invention, will become more readily apparent: by referring to the exemplary, and therefore non-limiting embodiments illustrated in the drawings, wherein identical reference numerals designate the same components. Note that the features illustrated in the drawings are not necessarily drawn to scale.

FIG. 7 is a perspective view of an alternate embodiment of a tumbler ring;

FIG. 8 is an elevational view of the tumbler ring of FIG. 7, viewed along line 8-8;

FIG. 9 is a perspective view of an alternate embodiment of a tumbler ring, illustrating a partial cross-section of the tumbler ring;

FIG. 13 is an elevational view of a tumbler ring illustrating both the un-installed shape and the installed shape of a tumbler ring;

DETAILED DESCRIPTION

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Figure 1:
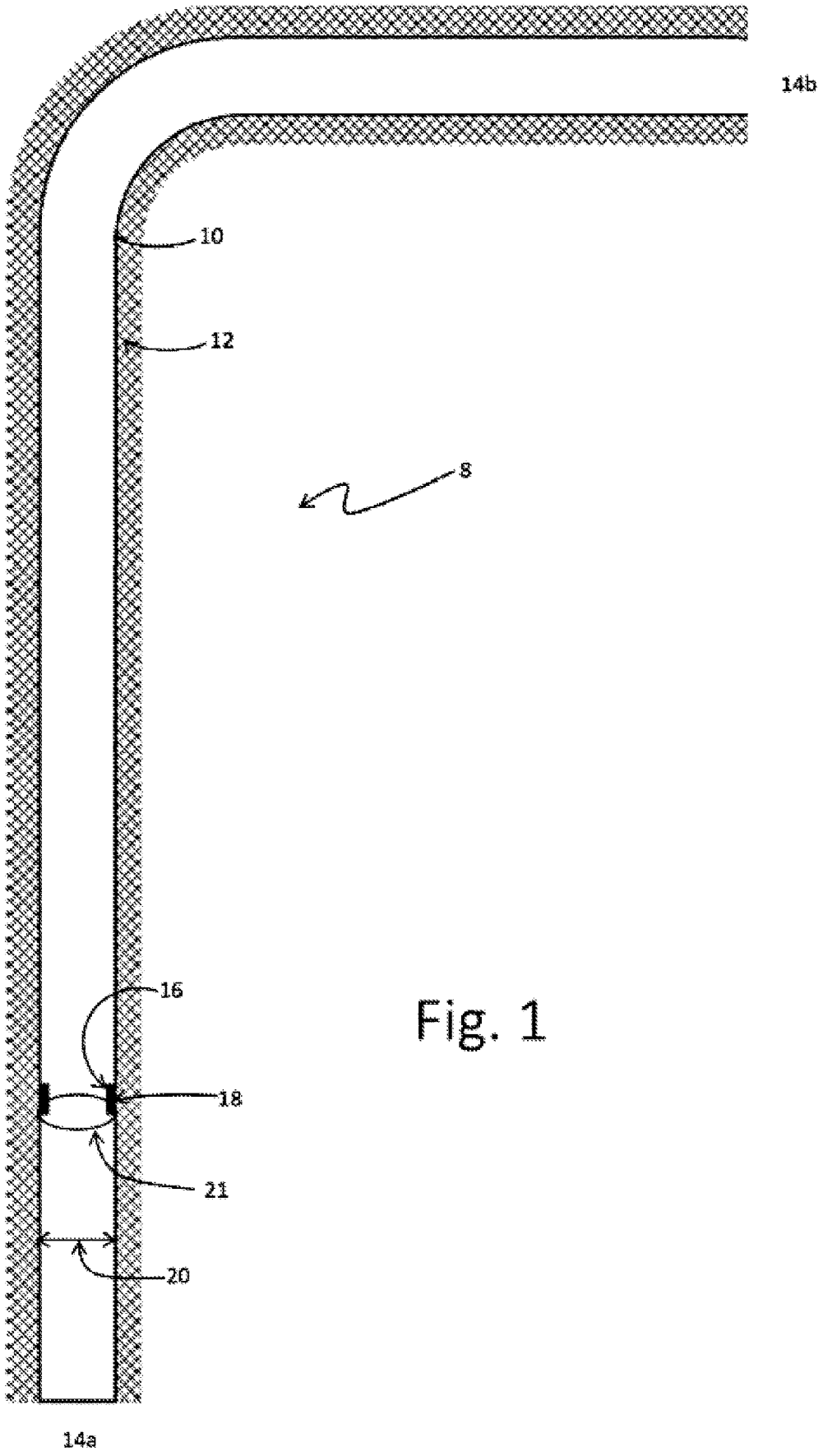
FIG. 1 is a diagrammatic representation of a schematic view through a subterranean well with a tumbler ring installed therein.

FIG. 1 illustrates a subterranean well 8 having a wellbore 10 located in formation 12. The subterranean well 8 includes a downhole end 14*a* and an uphole end 14*b*. FIG. 1 further illustrates a tumbler ring or ring 16 installed or deployed in the subterranean well 8. The tumbler ring 16 is installed or deployed at setting location 18. The wellbore 10 has an inner diameter 20 and an inner circumference 21 at the setting location 18. As will be discussed in more detail below, the tumbler ring 16 is deployed from the surface of the well 8 to the setting location 18 in a first orientation. When the tumbler ring 16 is at the setting location 18, the tumbler ring 16 is rotated or tumbled from a first orientation to a second orientation by a deployment device. Rotating the tumbler ring 16 from the first orientation to the second orientation causes the major diameter of the tumbler ring 16 to engage an inner circumference 21 of the subterranean well at the setting location 18. This engagement results in reducing the major diameter of the tumbler ring 16 thereby causing the tumbler ring to generally take the shape of the inner circumference 21 of the subterranean well 8 at the setting location 18. It is the deformation and conformance of the tumbler ring 16 to the inner circumference 21 of subterranean well 8 that secures the tumbler ring in the subterranean well 8 at the setting location 18.

The setting location 18 may be at any location in the subterranean well 8, and the tumbler ring 16 may be configured for the setting location based on the inner diameter or inner circumference of the subterranean well. One advantage of the invention is that the tumbler ring 16 may operate in several types of wellbores. For example, those skilled in the art will also appreciate that the tumbler ring 16 may also be set in sections of a wellbore that do not contain any tubulars. These sections are generally known to the industry as open hole. In this instance, the tumbler ring 14 will interact with the exposed geological formation.

FIG. 1 illustrates a single tumbler ring deployed at a single setting location, however, those skilled in the art will understand that the invention is not limited to a single tumbler ring or a single setting location. Multiple tumbler rings may be deployed at one setting location and/or multiple tumbler rings may be deployed at multiple setting locations. Furthermore, a single tumbler ring may be deployed at a first setting location and then later uninstalled and possibly deployed at a second setting location. Finally, tumbler ring 16 may be made of a material that galvanically corrodes in the subterranean well 8 or made of a material that disintegrates or dissolves as a result of an interaction with a fluid in the subterranean well 8. Examples of these materials include but are not limited to: an Aluminum alloy that could dissolve through interaction with hydrochloric acid, or composite material made elastomers that dissolve through interaction with water based fluids.

Figure 2:
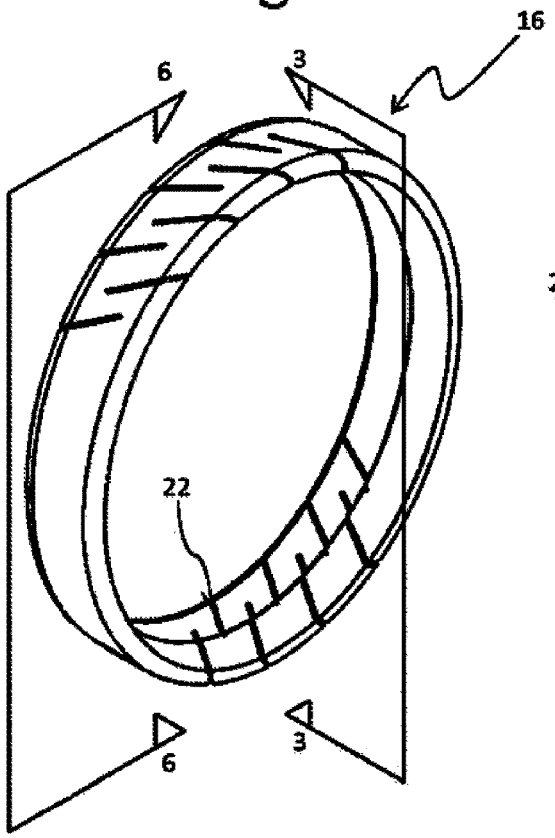
FIG. 2 is a perspective view of a tumbler ring.

FIG. 2 illustrates a perspective view of an embodiment of the tumbler ring 16. In this embodiment, the tumbler ring 16 may include slots 22 to enhance the ductility of the tumbler ring when taking the shape of the inner circumference of the wellbore 10 at the setting location 18. The enhanced ductility of the tumbler ring 16 provided by the slots in this embodiment aids in the rotation of the tumbler ring (i.e., tumbling) when the tumbler ring is at the setting location. The slots 22 may be designed to narrow or even close when a compressive force is applied during interaction with a wellbore wall, ball, dart, or other device.

Figure 3:
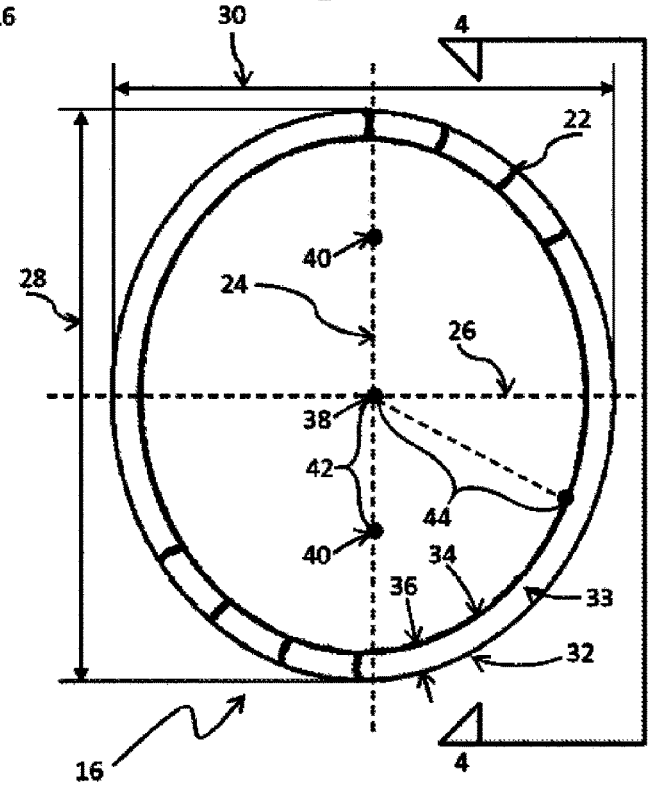
FIG. 3 is an elevational view of the tumbler ring of FIG. 2, viewed along line 3-3.

FIG. 3 is an elevational view of the tumbler ring of FIG. 2, viewed along line 3-3. As illustrated in FIG. 3, some embodiments of tumbler ring 16 may have a generally oval shape with a major axis 24 and a minor axis 26. The major axis 24 defines a major diameter 28 of the tumbler ring 16, and the minor axis 26 defines a minor diameter 30 of the tumbler ring. FIG. 3 further illustrates that the tumbler ring 16 has an outer circumference or outer perimeter 32, an inner circumference or inner perimeter 34, and a wall 33 having a wall thickness 36. FIG. 3 illustrates an embodiment where the tumbler ring has a uniform wall thickness 36 around the entire circumference. A person of ordinary skill in the art would understand that the wall thickness 36 does not need to uniform around the circumference and can be varied. In other words, the invention is not limited to a tumbler ring having a uniform wall thickness around the circumference.

In some embodiments, the major axis 24 of the tumbler ring is generally perpendicular to the minor axis 26 of the tumbler ring, and the tumbler ring 16 has two axes of symmetry. In other words, the tumbler ring 16 may be in the shape of an ellipse having a substantially constant eccentricity. Those skilled in the art will understand that eccentricity of an ellipse is a measure of how nearly circular or "out of round" the ellipse is. Eccentricity may be determined by the following formula: eccentricity=c/a, where "c" is the distance from the center of the ellipses to a focus of the ellipse, and "a" is the distance from that focus to a vertex. For example, the center of the ellipse is illustrated in FIG. 3 as point 38, and the first and second focus of the ellipse is illustrated at points 40. As indicated, the eccentricity of the ellipse may be determined as the distance 42 over the distance 44. Those skilled in the art would understand that in practice the tumbler ring will not have perfect eccentricity, but instead may have a substantially constant eccentricity that accounts for variations in tolerances and manufacturing.

More importantly, the invention does not limit the shape of the tumbler ring to an ellipse, but may include various shapes including an oval having only a single axis of symmetry, or no axis of symmetry. In addition, major axis 24 and a minor axis 26 do not need to be located at the center of the shape of the tumbler ring. In summary, an advantage of embodiments of the invention is that symmetry is not required. The only shape requirements are that the major diameter 28 of the tumbler ring 16 is larger than the inner diameter 20 of the wellbore 10 at the setting location 18 and that that the minor diameter 30 of the tumbler ring 16 is smaller than the inner diameter 20 of the wellbore 10 at the setting location 18.

FIG. 3 further illustrates the slots 22 that enhance the ductility of the tumbler ring. As discussed, the slots may reduce the force needed to rotate the tumbler ring 16 when it is engaged at the setting location. As illustrated in FIG. 3, the slots 22 extend through the entire wall thickness 36 of the tumbler ring. Instead of slots 22, or in addition to slots 22, other embodiments of the tumbler ring 16 may include a hole, gap, or even a fully enclosed space within the wall thickness 36.

Figure 4:
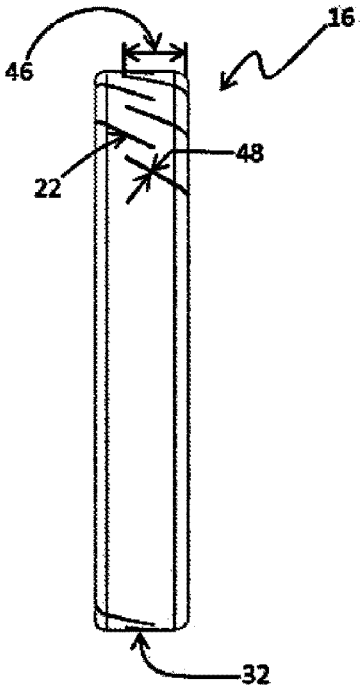
FIG. 4 is an elevational view of the tumbler ring of FIG. 3, viewed along line 4-4.

FIG. 4 is an elevational view of the tumbler ring of FIG. 3, viewed along line 4-4. FIG. 4 illustrates slots 22 located on the outer circumference 32 and extending through the wall thickness 36 of the tumbler ring 16. As illustrated, slots 22 may have a width 48 and extend a distance or a length 46 from a face of the tumbler ring. The number of slots 22, the width of the slots 48, and the length of the slots 46 may be adjusted to increase or decrease the ductility of the tumbler ring 16. As discussed, the ductility of the tumbler ring impacts the rotation of the tumbler ring when the tumbler ring is engaged at the setting location.

In addition to slots 22, the tumbler ring 16 may also have any of its outer surfaces modified to enhance gripping and/or sealing to the wellbore walls. For example, the tumbler ring could have its outer circumference 32 modified to enhance gripping and/or sealing to the wellbore walls. Such enhancement may include, but not limited to, particles such as silicon carbide (SiC) attached to the outer circumference 32, which may be harder than the material of the wellbore and/or the tumbler ring. Attachment of these particles can be accomplished using an epoxy or resin or other methods including but not limited to sintering. Another enhancement may include a profile machined or attached to the outer circumference 32. The profiles may be treated to increase their hardness. Another enhancement may include a sealing system such as an elastomer or thermo plastic bonded to the tumbler ring. Those skilled in the art will appreciate that many different gripping and sealing systems or components exist and can be used on their own or in combination with each other.

Figure 5:
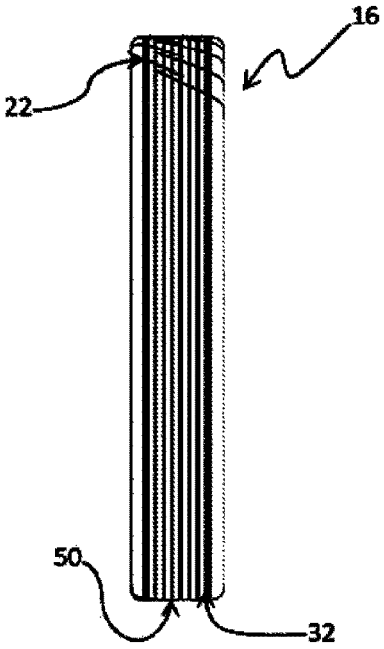
FIG. 5 is an elevation view of an alternate embodiment of a tumbler ring.

FIG. 5 is an elevation view of an alternate embodiment of the tumbler ring 16. FIG. 5 illustrates slots 22 visible on the outer circumference 32 and extending through the wall thickness 36 of the tumbler ring 16. FIG. 5 further illustrates an example of a profile 50 that may be machined in or on the outer circumference 32 of the tumbler ring 16. The profile 50 can be hardened to enhance the gripping between the tumbler ring 16 and the inner circumference of the subterranean well at the setting location.

Figure 6:
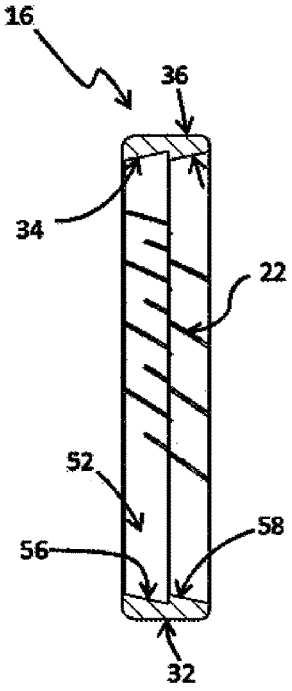
FIG. 6 is a cross-sectional view of an alternate embodiment of a tumbler ring, viewed along line 6-6.

FIG. 6 is a cross-sectional view of an embodiment of a tumbler ring, viewed along line 6-6 of FIG. 2. FIG. 6 illustrates an example of an inner profile 52 located on the inner circumference 34 of the tumbler ring 16. In this embodiment, the inner profile 52 includes a first ramp or wedge 56 and a second ramp or wedge 58. As discussed, another device or system such as a ball or dart can be installed to interact with the tumbler ring to collectively form a plug and/or to further enhance conformance of the tumbler ring with the inner wellbore wall and/or enhance the gripping/sealing capabilities or other properties, performance, or features. The inner profile 52 illustrated in FIG. 6 may be used to enhance the interaction of other devices with the tumbler ring 16. These other devices or systems may be installed during, with, or after the installation of the tumbler ring. Some of these devices or systems can be used to enhance the ease of installation of the tumbler ring. The inner profile 52 illustrated in FIG. 6 is one example of an inner profile, and those skilled in the art would understand that this profile can take numerous shapes and forms.

FIG. 7 is a perspective view of an alternate embodiment of the tumbler ring. Specifically, FIG. 7 illustrates an example of a c-ring embodiment. In this embodiment a slot 60 having a width 62 extends through the wall thickness 36 for the entire length 64 of the tumbler ring 16. Those skilled in the art would understand that slot 60 may further increase the ductility of the tumbler ring 16. Moreover, those skilled in the art would understand that the embodiment illustrated in FIG. 7 may be one example where the shape of the tumbler ring 16 may not have a perfect eccentricity or may be more oval due to variations in tolerances, manufacturing, and material properties. For example, splitting the tumbler ring may cause it to spring from an eccentric shape to a non-eccentric shape.

FIG. 8 is an elevational view of the tumbler ring of FIG. 7, viewed along line 8-8. FIG. 8 illustrates the tumbler ring 16 having a major axis 66 and a minor axis 68. The major axis 66 defines a major diameter 70 of the tumbler ring 16, and the minor axis 68 defines a minor diameter 72 of the tumbler ring. As illustrated in FIG. 8, the major axis 66 may not be perpendicular (i.e., not at a 90 degree angle) with the minor axis 68, but instead may be at angle 74 that is less than or greater than 90 degrees. As discussed above, one advantage of embodiments of the invention is that symmetry is not required because the major diameter 70 of the tumbler ring 16 is larger than the inner diameter 20 of the wellbore 10 at the setting location 18. FIG. 8 further illustrates an outer circumference or outer perimeter 32, an inner circumference or inner perimeter 34, and a wall having a wall thickness 36 of the tumbler ring 16.

FIG. 9 is a perspective view of an alternate embodiment of the tumbler ring. FIG. 9 further illustrates a partial cross-section of the tumbler ring and indicates that the tumbler ring may include at least one void 76 contained within the wall thickness 36 of the tumbler ring. The void 76 does not extend to the outer circumference of the tumbler ring 32 or the inner circumference of the tumbler ring 34. Those skilled in the art would understand that void 76 can be embedded within the wall by using advanced manufacturing technologies such as additive manufacturing (including 3D printing). As illustrated, the void 76 is embedded within the wall and thus is not visible from either the outer circumference 32 or the inner circumference 34 of the tumbler ring. The void 76 may be partially or wholly filled with air, gas, vacuum, elastomers, thermoplastics, tracer chemicals or combinations thereof. Furthermore, the void 76 can be of any shape or size within the wall thickness 36. In certain embodiments, void 76 may be sized to reduce the amount of material of the tumbler ring 16 thereby reducing the volume of material that galvanically corrodes or disintegrates art the subterranean well.

Figure 10:
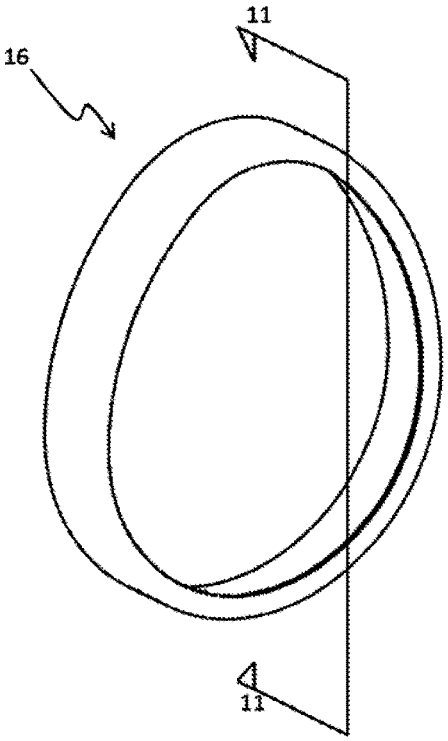
FIG. 10 is a perspective view of an alternate embodiment of a tumbler ring.
Figure 11:
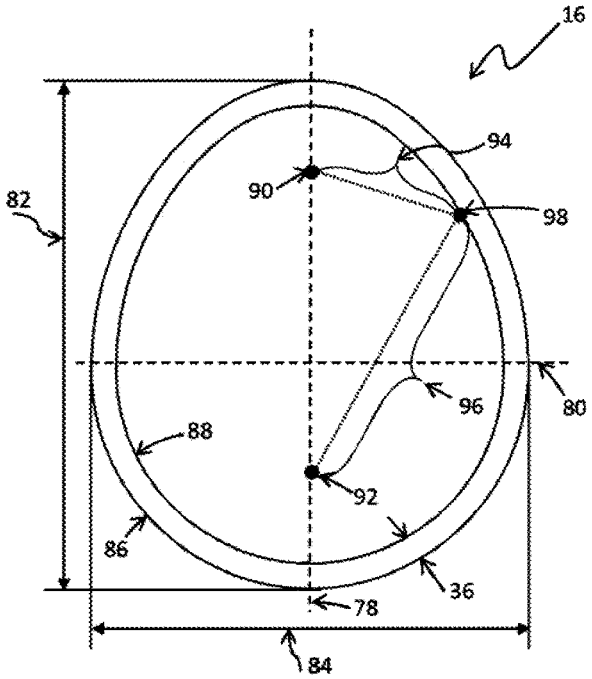
FIG. 11 is an elevational view of the tumbler ring of FIG. 10, viewed along line 11-11.

FIG. 10 is a perspective view of an alternate embodiment of a tumbler ring. As illustrated in FIG. 10, the tumbler ring 16 may have an egg shape, which is smaller at one end, and only has one axis of symmetry. FIG. 11 is an elevational view of the tumbler ring of FIG. 10, viewed along line 11-11. The egg shape tumbler ring illustrated in FIG. 10 and FIG. 11 includes a major axis 78 and a minor axis 80. The major axis 78 defines a major diameter 82 of the tumbler ring 16, and the minor axis 80 defines a minor diameter 84 of the tumbler ring. FIG. 11 further illustrates that the tumbler ring 16 has an outer circumference or outer perimeter 86, an inner circumference or inner perimeter 88, and a wall having a wall thickness 36. Although not shown in FIG. 10 or FIG. 11, the tumbler ring 16 may include slots through the as gall or voids embedded within the wall thickness 36 as discussed above.

In the embodiment illustrated in FIG. 11, the major axis 78 of the tumbler ring is generally perpendicular to the minor axis 80 of the tumbler ring, and the major axis 78 is an axis of symmetry. In other words, the tumbler ring 16 may be in the shape of an egg having a first focus 90 and a second focus 92. Those skilled in the art will understand that the general shape of a Cartesian Oval may include all the points for which the sum of the distance 96 from a vertex 98 to one focus 92 plus a multiple of the distance 94 from a vertex 98 to a second focus 90 remains generally constant. Those skilled in the art would understand that in practice the shape of the tumbler ring must account for variations in tolerances, material properties, and manufacturing processes, and the tumbler ring 16 would not necessarily be a perfect Cartesian Oval.

Moreover, embodiments of the invention are not limited to the shape of a Cartesian Oval and may include other shapes including but not limited to; egg, oval or ellipse shapes. As discussed, one advantage of embodiments of the invention is that the major diameter 82 of the tumbler ring 16 is larger than the inner diameter 20 of the subterranean well 8 at the setting location 18.

Figure 12:
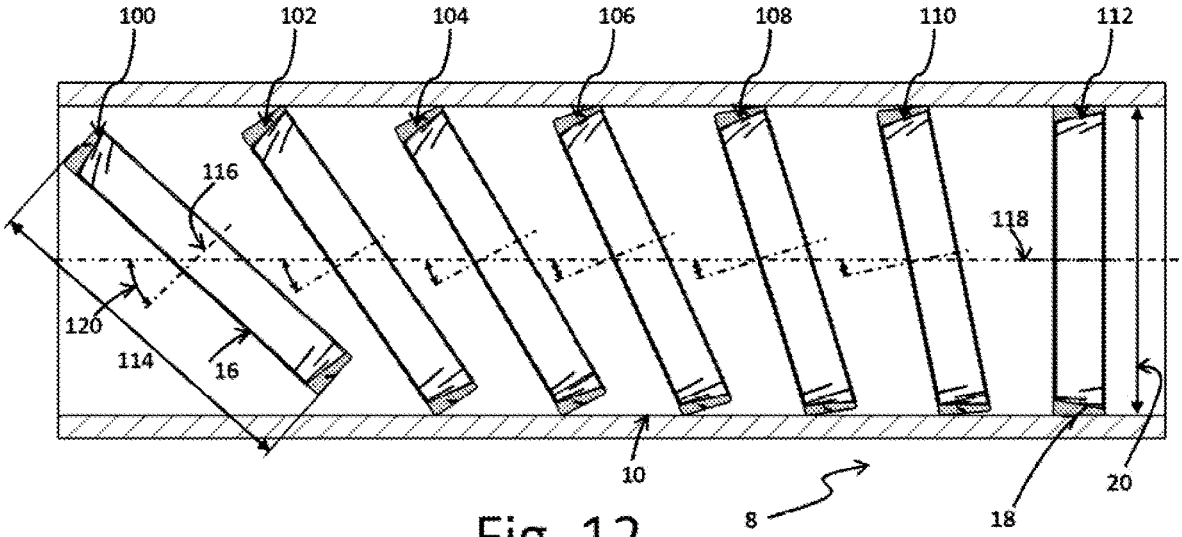
FIG. 12 is a cross-sectional view illustrating a tumbler ring rotating horn a first orientation to a second orientation in a subterranean well.

FIG. 12 is a cross-sectional view illustrating the tumbler ring 16 tumbling or rotating from a first orientation 100 to a second orientation 112 in a subterranean well 8. As illustrated in FIG. 12, the tumbler ring 16 may be in a first orientation 100 when traversing the wellbore 10. As discussed above, the tumbler ring includes a major diameter 114 that is larger than the inner diameter 20 of the wellbore 10 at the setting location 18. Thus, the first orientation 100 may be described as positioning the centerline 116 of the tumbler ring at an angle 120 to the centerline 118 of the wellbore 10. It is by placing the tumbler ring 116 in the first orientation 100 that enables the tumbler ring to be deployed in the wellbore 10. Those skilled in the art will understand that centerlines 118 and 116 are used to illustrate relationships and do not have to be at the center of either the tumbler ring 16 or the wellbore 10.

FIG. 12 further depicts a sequence of rotating from the first orientation 100, which is the run-in-hole orientation, to the second orientation 112, which is the set orientation. As illustrated in FIG. 13, the angle 120 between the centerline 116 of the tumbler ring 16 and the centerline 118 of the wellbore 10 is reduced until the centerlines are essentially parallel, as shown when the tumbler ring 16 is in the second orientation at position 112. At each position, the major diameter 114 is reduced due to the interaction with the inner diameter 20 of the wellbore 10, while the minor diameter of the tumbler ring is increased. It is through the engagement of the major diameter 114 with the inner diameter 20 of the wellbore that the tumbler ring substantially deforms and generally takes the shape of the inner circumference of the wellbore 10 at the setting location 18, thereby securing the tumbler ring 16 in the subterranean well 8 at the setting location 18. It should also be noted, that while FIG. 12 illustrates the axis 116 of tumbler ring 16 parallel with the axis 118 of the wellbore 10 when the tumbler ring 16 is in the second orientation, embodiments of the present invention are not so limited. In fact, depending on the application, positions 110, 108, 106 or any position in between may be an acceptable second orientation of the tumbler ring.

FIG. 13 is an elevational view of an embodiment of a tumbler ring illustrating both the un-installed shape 122 of the tumbler ring and the installed shape 124 of the tumbler ring 16, where the tumbler ring generally takes the shape of the inner circumference of the wellbore 10 at the setting location. As discussed, the tumbler ring 16 has a major diameter 114 that is larger than the inner diameter 20 of the wellbore 10 at the setting location. The tumbler ring 16 also has a minor diameter 126 that is smaller than the inner diameter 20 of the wellbore 10 at the setting location. Thus, FIG. 13 illustrates an example of the generally oval shape 122 of the tumbler ring 16 before it is run in a subterranean well. The generally oval shape 122 is placed on top of the shape 124 of the tumbler ring after it has generally taken the shape of the inner circumference of the wellbore 10. As such, FIG. 13 also generally depicts the difference in major diameter 114 and the inner diameter 20 of the wellbore 10 at the setting location. FIG. 13 further depicts an example of the shape of the tumbler ring after it has been deployed and set in the subterranean well 8. As indicated in FIG. 13, after the tumbler ring is set, the major diameter 114 of the tumbler ring is generally the same shape as the inner diameter 20 of the wellbore at the setting location.

Figure 14:
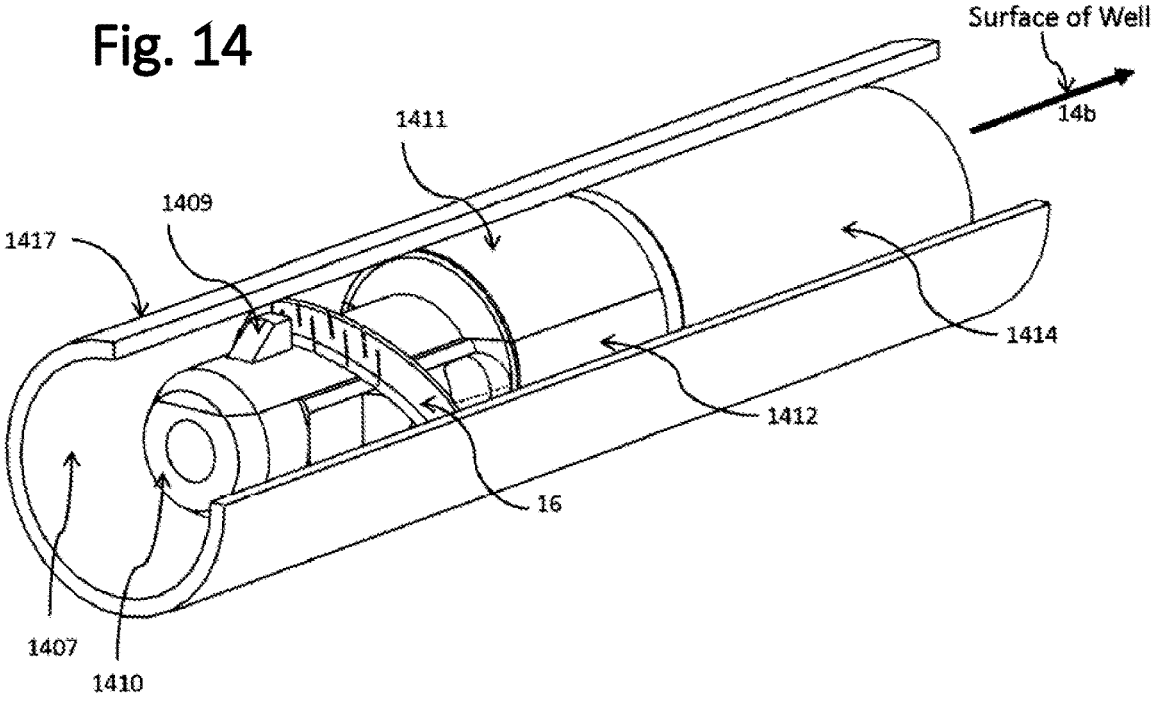
FIG. 14 is a perspective view of a tumbler ring positioned on a deployment device inserted in a wellbore before tumbler ring is rotated and set.

FIG. 14 is a perspective view of a tumbler ring positioned on a deployment device inserted in a wellbore. FIG. 14 illustrates a deployment device 1410 designed to work with an exemplary industry standard setting tool 1414. Those skilled in the art would understand that non-standard setting tools may also be used. Referring to FIG. 14, the deployment device includes a lug 1409, a pulling or static section 1411, and a pushing section 1412. The tumbler ring 16 is positioned on the deployment device 1410 in a first orientation with shear screws (not shown).

FIG. 14 illustrates the assembly that includes the setting tool 1414, the deployment device 1410, and the tumbler ring 16 that may be lowered (typically on a cable or workstring) into a tubular or wellbore 1417. When the assembly has reached the setting location, the setting tool 1414 is activated. Upon activation, the setting tool 1414 causes the pushing section 1412 to push against tumbler ring 16 which in turn pushes against lug 1409. The bottom of the tumbler rim 16 is restricted from moving by the static (pulling) section 1411 of the deployment device 1410. Accordingly, the tumbler ring 16 begins to rotate or tumble and deform to the inner circumference of the wellbore 1417 due to interaction with the inner circumference 1407 of the wellbore 1417. After the rotation is complete, the lug 1409 will move into a recess inside pushing section 1412 allowing the deployment device 1410 to release from the tumbler ring 16, and be removed from the wellbore. As discussed above, after the rotation of the tumbler ring is complete, the tumbler ring 16 will generally take the shape of the inner circumference 1407 of the wellbore at the setting location to secure the tumbler ring in the subterranean well at the setting location.

Figure 15:
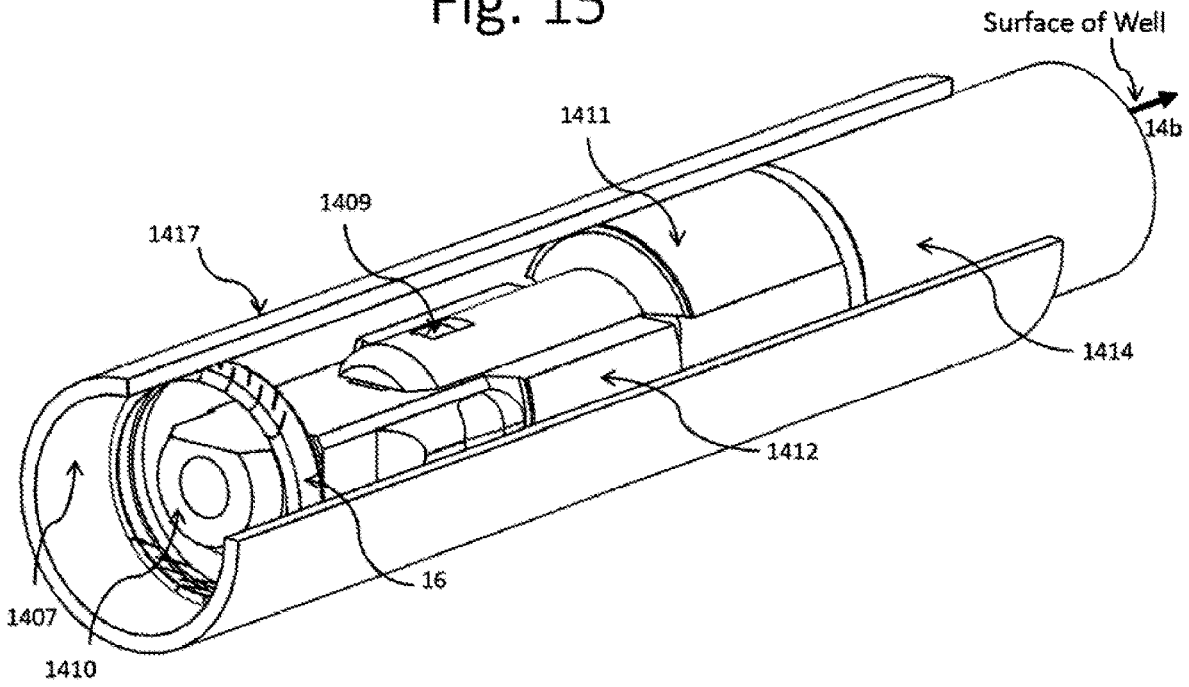
FIG. 15 is a perspective view of the tumbler ring of FIG. 14 rotated and installed in a wellbore.

FIG. 15 is a perspective view of the tumbler ring of FIG. 14 rotated and installed in a subterranean well. FIG. 14 illustrates the deployment device 1410 after the setting/tumbling sequence has been completed. That is, after the setting tool 1410 has been activated and released from the tumbler ring 16. The tumbler ring 16 is rotated and has generally taken the shape of the inner circumference 1407. FIG. 15 farther illustrates lug 1409 retracted and the deployment device 1410 released from the tumbler ring 16. As illustrated, the deployment device 1410 and setting tool 1414 have not yet been completely removed from the wellbore 1417.

Figure 16:
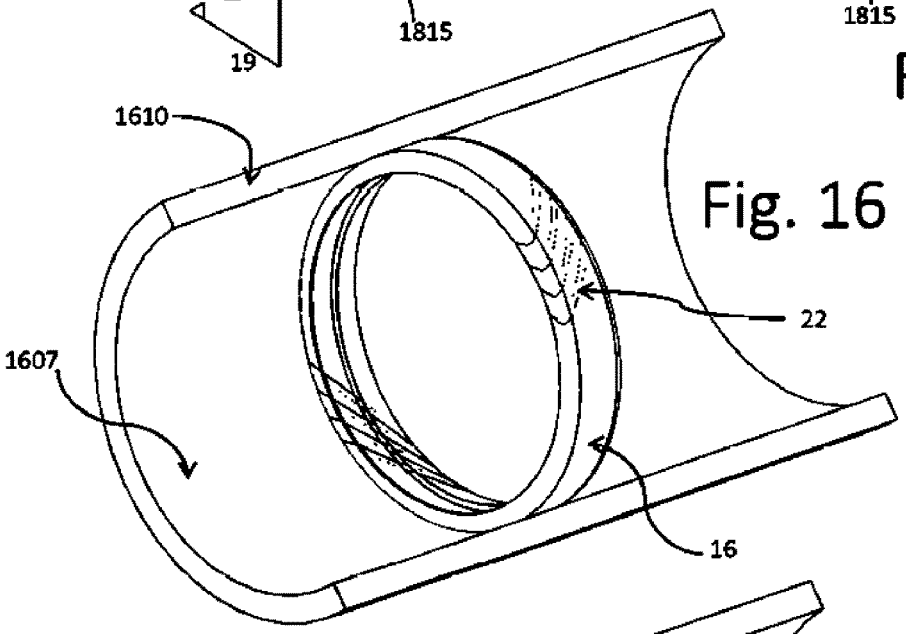
FIG. 16 is a perspective view of the tumbler ring installed in a wellbore, illustrating a partial cross-section of the subterranean well.

FIG. 16 is a perspective view of the tumbler ring 16 installed in a subterranean well 1610. FIG. 16 illustrates the tumbler ring 16 after it has been rotated (tumbled) and set within a wellbore 1607, shown as a partial cross-section. As discussed above, the slots 22 may be narrowed due to the compressive forces exerted on the tumbler ring by interaction with the wellbore 1607 during and/or after the tumbling process.

Figure 17:
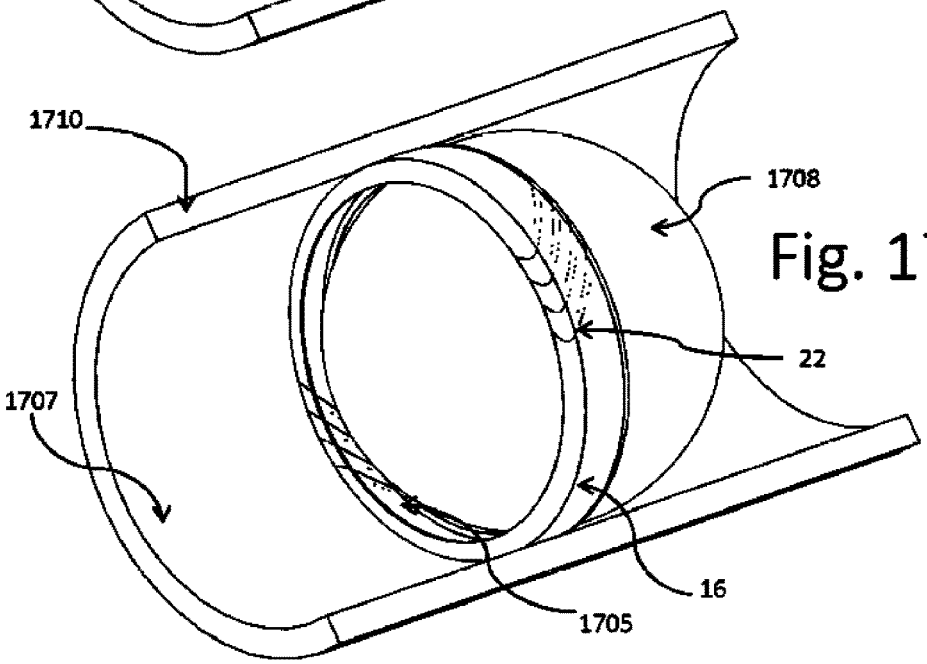
FIG. 17 is a perspective view of the tumbler ring and ball installed in a subterranean well, illustrating a partial cross-section of the subterranean well.

FIG. 17 is a perspective view of the tumbler ring 16 and a ball 1708 installed in a subterranean well 1710. FIG. 17 illustrates tumbler ring 16 after it has been rotated (tumbled) and set within a wellbore 1707, shown as a partial cross-section. The ball 1708 is installed (typically dropped from the surface) and engages the inner profile 1705 of the tumbler ring 16. Thus, when a three is applied on top of the ball 1708, the ball 1708 will interact with the profile 1705 to further energize the gripping and/or sealing of the tumbler ring 16 against the wellbore 1707, and the slots 22 may be forced to narrow further.

Figure 18:
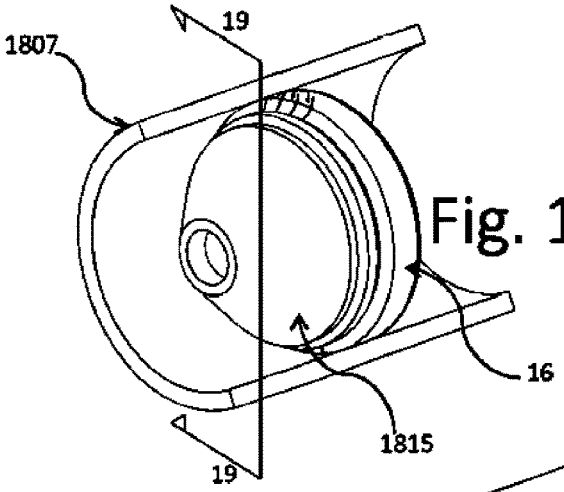
FIG. 18 is a perspective view of the tumbler ring installed in a wellbore, illustrating a partial cross-section of the subterranean well.
Figure 19:
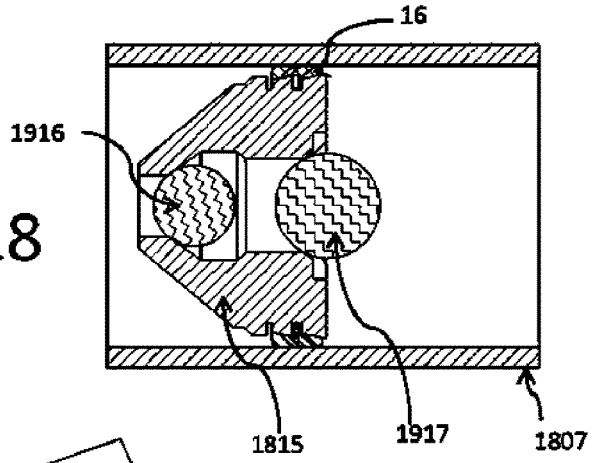
FIG. 19 is a cross-sectional view of the tumbler ring and ball seat of FIG. 18, viewed along line 19-19, illustrating the tumbler ring and ball seat installed in a wellbore.

FIG. 18 is a perspective view of the tumbler ring 16 and a ball seat 1815 installed in a subterranean well 1807, illustrating a partial cross-section of the subterranean well 1807. FIG. 19 is a cross-sectional view of the tumbler ring and ball seat 1815 of FIG. 18, viewed along line 19-19, illustrating the tumbler ring and ball seat installed in a subterranean well. As illustrated in these figures, the ball seat 1815 is installed and tumbled together with the tumbling ring 16. The ball seat 1815 may include a first ball 1916 that is installed when the ball seat 1815 is tumbled, or the first ball 1916 may be installed at a later time. A second ball 1917 can also be installed to provide redundancy in case of a failure or degradation of the first ball 1916. Those skilled in the art will understand that the tumbler ring 16, ball seat 1815, the first ball 1916 and/or the second ball 1917 can be made from a variety of materials, including but not limited to degradable or dissolvable materials. This will eliminate or substantially reduce the milling or grinding operations.

Figure 20:
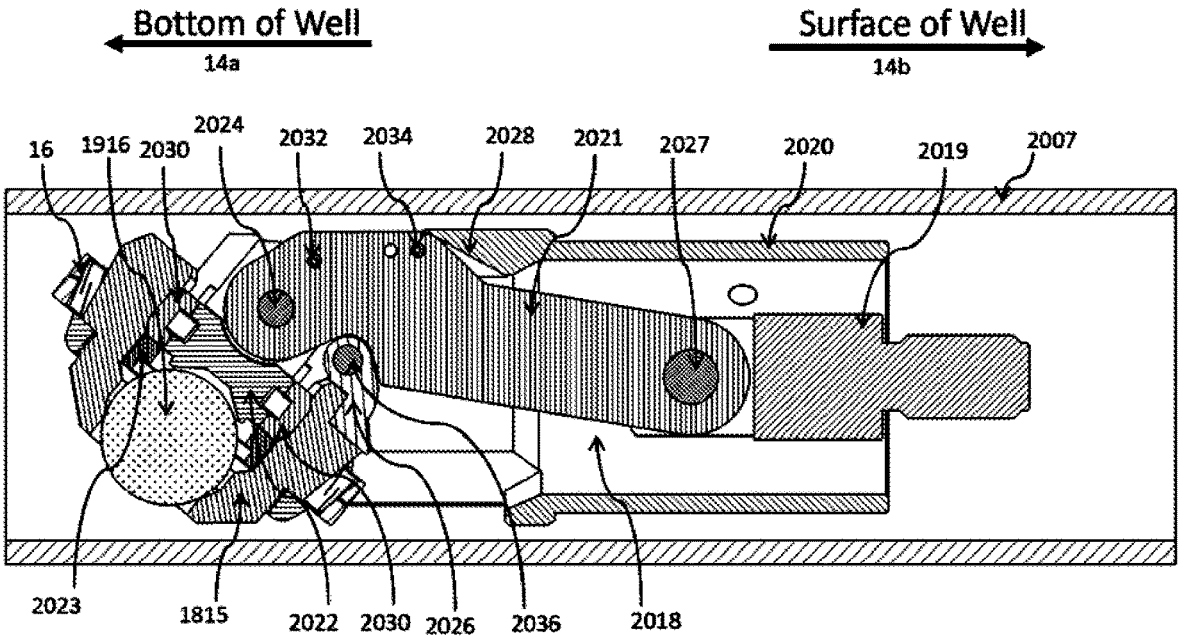
FIG. 20 is a cross-sectional view of the tumbler ring and ball seat positioned on a deployment device inserted in a subterranean well.

FIG. 20 is a cross-sectional view of an embodiment of a deployment device 2018 inserted in a subterranean wellbore 2007 that may be used to deploy the tumbler ring 16 and the ball seat 1815 illustrated in FIG. 18 and FIG. 19. The tumbler ring 16 and the ball seat 1815 may be conveyed into a subterranean well and then set (rotated or tumbled) at a setting location in wellbore 2007. As illustrated, the tumbler ring 16 is installed on the ball seat 1815. Portions of the ball seat 1815 may be adapted such that when the tumbler ring 16 is installed on the ball seat 1815, and attached to the deployment device 2018, the entire assembly can traverse the wellbore and tubulars 2007 and reach the target setting location.

When the assembly has reached the target setting location, the setting tool (not shown) is activated. Upon activation, the setting tool will push downwards against the setting sleeve 2020 effectively pulling upwards on the adapter sub 2019 while pushing downwards against setting sleeve 2020, which will cause setting sleeve 2020 to move downwards relative to adapter sub 2019. Adapter sub 2019 is connected to tension plate 2021 via a hinge pin 2027 which is connected to dog release sub 2022 via shear pin 2024. The dog release sub 2022 supports the dogs 2030. Shear pin 2024 is also connected to dog housing 2023. Thus, pulling upwards on adapter sub 2019 while pushing downwards on setting sleeve 2020 will cause the tension plate 2021 to break the shear pins 2032 and 2034. Once the shear pins 2032 and 2034 are broken, the tension plate 2021 will move towards the center of setting sleeve 2020 via shoulder 2028.

The above described movement of the tension plate 2021 will cause the tumbler ring 16 and ball seat 1815 to rotate. During the rotation, the ball seat 1815 is pulled against the setting sleeve 2020 and guide nose 2026 until the pulling force is great enough to break shear pin 2024, which will then allow the dog release sub 2022 to move such that the dogs 2030 are no longer supported. With the dogs 2030 no longer supported, the deployment device 2018 is released from the ball seat 1815. After being released, the dogs 2030 are contained by dog housing 2023. The guide nose can rotate around hinge 2036. After release; the setting tool (not shown) and deployment device 2018 can be removed from the wellbore 2007, leaving the ball seat 1815, ball 1916, and tumbler ring 16 set in the wellbore 2007.

Figure 21:
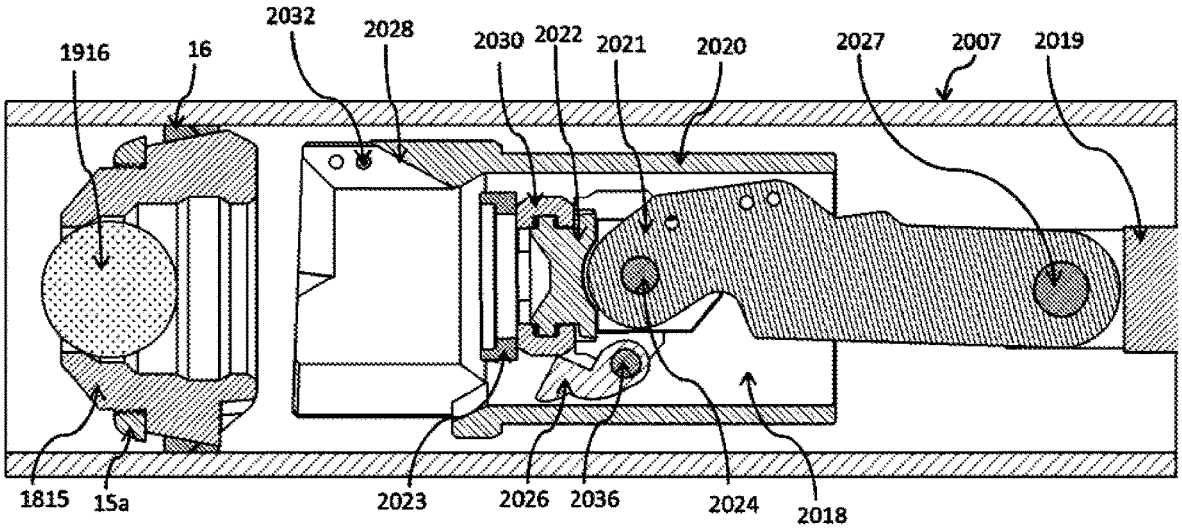
FIG. 21 is a perspective view of the tumbler ring and ball seat of FIG. 21 rotated and installed in a subterranean well.

FIG. 21 is a cross-sectional view of the tumbler ring 16 and ball seat 1815 of FIG. 20 rotated and installed in a subterranean well. FIG. 21 illustrates a view after the steps described in FIG. 20 have been completed. The tumbler ring 16 is set and generally taken the shape of the inner circumference of the wellbore 2007 at the setting location thereby securing the tumbler ring in the subterranean well at the setting location. The ball seat 1815 is also rotated and released from the deployment device 2018. The deployment device 2018, which is attached to the setting tool (not shown) may be removed from the wellbore 2007.

It should be understood that deployment device 2018 deploys the tumbler ring 16. However, device 2018 may also be altered to remove or retrieve the tumbler ring 16. Such a device may be referred to as a removing device. The removing device may by positioned in the subterranean well to engage the ring. The removing device may be activated to rotate the ring from the set or second orientation to the unset or first orientation thereby causing the major diameter of the ring to disengage the inner circumference of the subterranean well at the setting location.

An optional indicator (not illustrated in FIG. 20 or FIG. 21) may be included in the deployment device 2018. In one embodiment, the indicator may be a tell-tale pin located in setting sleeve 2020 right below shear pin 2032. The tell-tale pin may be contained inside a hole in the setting sleeve 2020 and project out of the setting sleeve, and secured in place by a snap or shear pin. When the ring is tumbled, the ball seat 1815 would push against the tell-tale pin and push the tell-tale pin inside the setting sleeve 2020. Upon retrieval of the setting sleeve the tell-tale pin may indicate or otherwise communicate a level of engagement between the tumbler ring and the wellbore. The level of engagement may include an amount of displacement of the major diameter of the ring; the degree of rotation of the ring from a first orientation to a second orientation; and/or any other measurement, dimension, or performance indicator of interest related to the tumbling of the ring.

Figure 22:
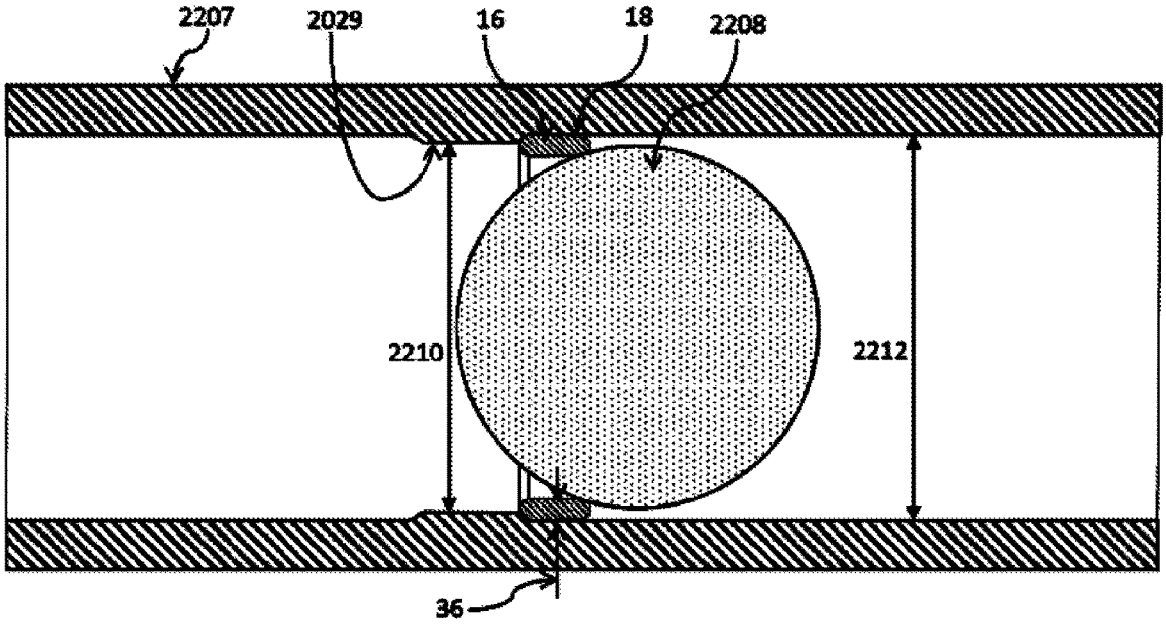
FIG. 22 is a cross-sectional view of the tumbler ring and ball installed in an alternate embodiment of a subterranean well.

FIG. 22 is a cross-sectional view of the tumbler ring 16 and ball 2208 installed at a setting location 18 in an alternate embodiment of a subterranean well. In this embodiment, the wellbore 2207 includes a shoulder 2029. The shoulder 2029 is formed in the wellbore 2207 by a second inner diameter 2210 at a second location having a smaller diameter than the inner diameter 2212 at the setting location 18. The shoulder 2029 provides additional support for the tumbler ring 16. At least a portion of the wall thickness 36 of the tumbler ring 16 engages the shoulder 2029 to further secure the tumbler ring 16 in the subterranean well. In one embodiment, the tumbler ring 16 may be set on shoulder 2029 or some distance above the protruding shoulder 2029, and then pushed onto the protruding shoulder 2029 when required. Setting and rotating of the tumbler ring 16 may be done using the deployment device described above. FIG. 22 illustrates a ball 2208 dropped and/or pumped in place, which may further energize the tumbler ring 16. The ball 2208 may also push the tumbler ring 16 towards or onto the protruding shoulder 2029 in certain embodiments.

Figure 23:
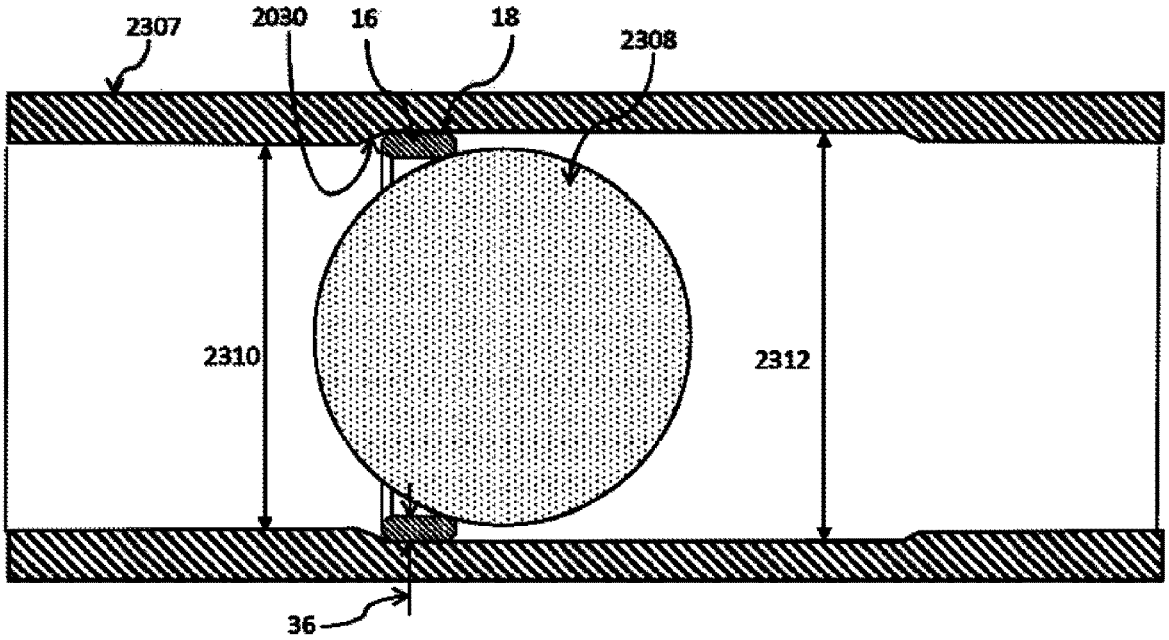
FIG. 23 is a cross-sectional view of the tumbler ring and ball installed in an alternate embodiment of a subterranean well.

FIG. 23 is a cross-sectional view of the tumbler ring 16 and ball 2308 installed at a setting location 18 in an alternate embodiment of a subterranean well. In this embodiment, the wellbore 2307 includes a recess having a downhole shoulder 2030. The shoulder 2030 is formed in the wellbore 2307 by a second inner diameter 2310 at a second location having a smaller diameter than the inner diameter 2312 at the setting location 18. As illustrated in FIG. 23, the setting location is located in a recess of Me wellbore 2307. The shoulder 2030 provides additional support for the tumbler ring 16. At least a portion of the wall thickness 36 of the tumbler ring 16 engages the shoulder 2030 to further secure the tumbler ring 16 in the subterranean well. In one embodiment, the tumbler ring 16 may be set on shoulder 2030 or some distance above the protruding shoulder 2030, and then pushed onto the protruding shoulder 2030 when required. Setting and rotating of the tumbler ring 16 may be done using the deployment device described above. FIG. 23 illustrates a ball 2308 dropped and/or pumped in place, which may further energize the tumbler ring 16. The ball 2308 may also push the tumbler ring 16 towards or onto the shoulder 2030 in certain embodiment.

Those skilled in the art will understand that recesses or protruding shoulders, similar to the ones illustrated in FIG. 22 and FIG. 23, can be installed within dedicated subs or integrated in existing connections. This may simplify installation of the protruding shoulders or recesses, and allow tumbler ring 16 with an integrated ball seat to be installed in combination with a protruding shoulder 2029 or recess 2030.

Figure 24:
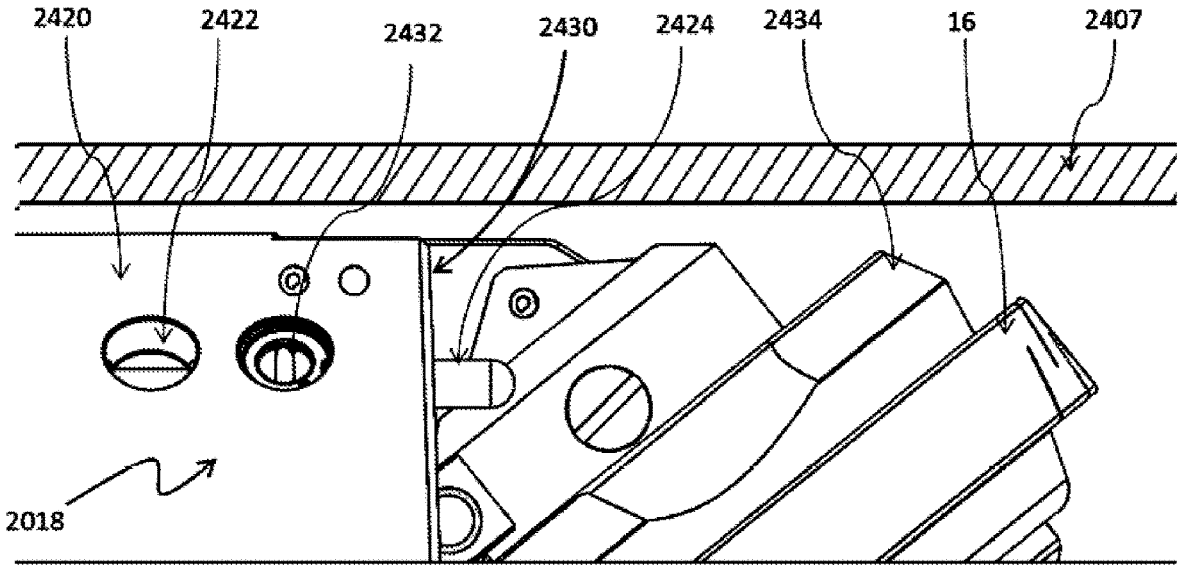
FIG. 24 is an elevational view of an indicator extending out from the front face of the setting sleeve

FIG. 24 is an elevational view of the deployment device 2018 illustrated in FIG. 20 and FIG. 21 further illustrating one embodiment of a tell-tale pin 2424 within the wellbore 2407 (illustrated as a partial cross-section) at the setting location. This embodiment of the tell-tale pin 2424 is located in setting sleeve 2420. The tell-tale pin is contained inside a hole or pocket 2422 within the setting sleeve 2420, and protrudes or projects out from a front face 2430 of the setting sleeve. The tell-tale pin is secured in place by a snap or spring clip 2432. When the setting tool is activated and the ring tumbled, the ball seat 2434 pushes against the tell-tale pin 2424 and displaces the tell-tale pin to retract inside the setting sleeve 2420.

Figure 25:
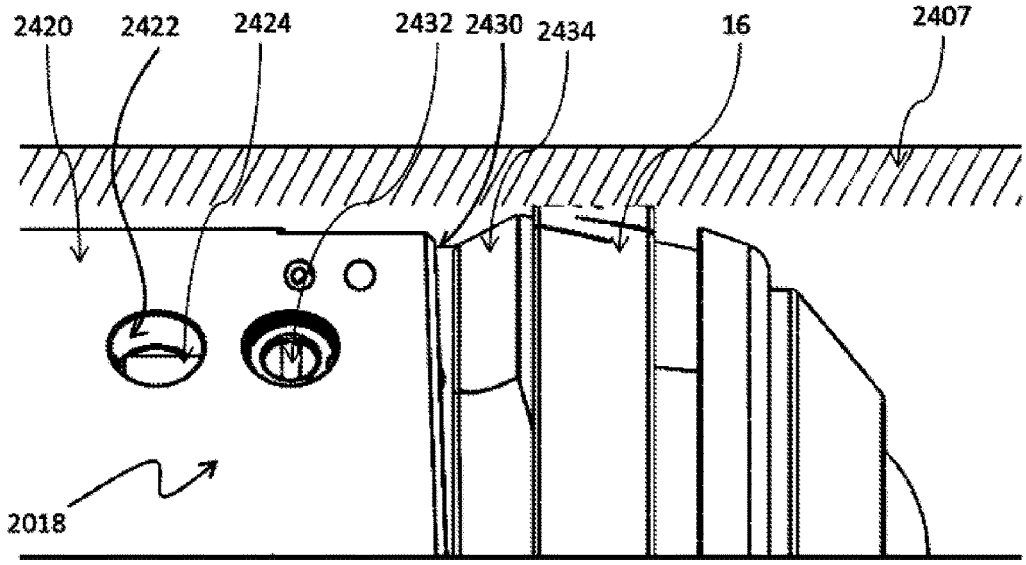
FIG. 25 is an elevational view of an indicator of FIG. 24 recessed below the front face of the setting sleeve and displaced inside the setting sleeve.

FIG. 25 is an elevational view of the tell-tale pin 2424 after the tumbler ring 16 has rotated and is set. In this embodiment, the tell-tale pin 2424 is shown displaced or retracted inside the setting sleeve 2420 by ball seat 2434. The tell-tale pin 2424 is secured in place by snap or spring clip 2432. Upon retrieval of the setting sleeve, the tell-tale pin ma indicate or otherwise communicate a level of engagement between the tumbler ring 16 and the wellbore 2407. For example, the depth of the of displacement of the tell-tale pin 2424 within the setting sleeve 2420, as viewed through hole or pocket 2422, may indicate the level of engagement between the tumbler ring 16 and the wellbore 2407. Similarly, the change in distance of the tell-tale pin's projection from the front face 2430 of the setting may also indicate a level of engagement. It is important to note that although FIGS. 24 and 25 illustrate a visual indicator of the level of engagement, a person of ordinary skill would understand that the level of engagement could be determined with an electrical sensor, such as a proximity sensor, and communicated to the surface or retrieved at the surface.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present) As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

The invention claimed is:

1. An apparatus configured to be deployed in a subterranean well at a setting location having an inner diameter and an inner circumference, the apparatus comprising:

a ring having an outer circumference, an inner circumference, and a wall having a wall thickness, wherein the ring has a generally oval shape with a major axis and a minor axis, wherein the major axis defines a major diameter of the ring and the minor axis defines a minor diameter of the ring, and the major diameter of the ring is larger than the inner diameter of the subterranean well at the setting location, and the minor diameter of the ring is smaller than the inner diameter of the subterranean well at the setting location, wherein the ring is further configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location.

2. The apparatus of claim 1, wherein the major axis of the ring is generally perpendicular to the minor axis of the ring.

3. The apparatus of claim 1, wherein the outer circumference of the ring is equal to or larger than the inner circumference of the subterranean well at the setting location before substantially deforming to the inner circumference of the subterranean well.

4. The apparatus of claim 1, wherein the wall of the ring includes at least one slot, hole, or gap.

5. The apparatus of claim 4, wherein the at least one slot, hole, or gap extends through the entire wall thickness of the ring.

6. The apparatus of claim 1, wherein the wall of the ring includes at least one void contained within the wall thickness of the ring that does not extend to the outer circumference of the ring or the inner circumference of the ring.

7. The apparatus of claim 1, wherein the outer circumference of the ring includes particles that engage the inner circumference of the subterranean well at the setting location.

8. The apparatus of claim 1, wherein the ring is made of a material that galvanically corrodes in a subterranean well.

9. The apparatus of claim 1, wherein the ring is made of a material that disintegrates as a result of an interaction with a fluid in a subterranean well.

10. The apparatus of claim 1, further comprising a second ring that is similar to the first ring, the second ring is configured to substantially deform to the inner circumference of the subterranean well at the setting location by reducing a major diameter of the second ring to cause the second ring to generally take the shape of the inner circumference of the subterranean well at the setting location to further secure the first ring and the second ring in the subterranean well at the setting location.

11. An apparatus configured to be deployed in a subterranean well at a setting location having an inner diameter and an inner circumference, the apparatus comprising:

a ring having an outer circumference, an inner circumference, a wall having a wall thickness, a major axis, and a minor axis, wherein the major axis defines a major diameter of the ring and the minor axis defines a minor diameter of the ring, and the major diameter of the ring is larger than the inner diameter of the subterranean well at the setting location, and the minor diameter of the ring is smaller than the inner diameter of the subterranean well at the setting location, wherein the ring is further configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location.

12. The apparatus of claim 11, wherein the major axis of the ring is generally perpendicular to the minor axis of the ring, and the ring has a generally oval shape having a substantially constant eccentricity.

13. The apparatus of claim 11, wherein the outer circumference of the ring is equal to or larger than the inner circumference of the subterranean well at the setting location before substantially deforming to the inner circumference of the subterranean well.

14. The apparatus of claim 11, wherein the wall of the ring includes at least one slot, hole, or gap.

15. The apparatus of claim 14, wherein the at least one slot, hole, or gap extends through the entire wall thickness of the ring.

16. The apparatus of claim 11, wherein the outer circumference of the ring includes a wave shape.

17. The apparatus of claim 11, wherein the ring is generally in the shape of an egg having a first focus and a second focus, and a sum of the distance from the first focus to a vertex and a multiple of the distance from the second focus to the vertex remains generally constant for any point on the outer circumference of the ring.

18. The apparatus of claim 11, wherein the wall of the ring includes at least one void contained within the wall thickness of the ring that does not extend to the outer circumference of the ring or the inner circumference of the ring.

19. The apparatus of claim 11, wherein the outer circumference of the ring includes particles that engage the inner circumference of the subterranean well at the setting location.

20. The apparatus of claim 11, wherein the ring is made of a material that galvanically corrodes in a subterranean well.

21. The apparatus of claim 11, wherein the ring is made of a material that disintegrates as a result of an interaction with a fluid in a subterranean well.

22. The apparatus of claim 11, further comprising a second ring that is similar to the first ring, the second ring is configured to substantially deform to the inner circumference of the subterranean well at the setting location by reducing a major diameter of the second ring to cause the second ring to generally take the shape of the inner circumference of the subterranean well at the setting location to further secure the first ring and the second ring in the subterranean well at the setting location.

23. A method of installing an apparatus in a subterranean well comprising:

providing a ring, the ring having an outer circumference, an inner circumference, a wall having a wall thickness, a major axis and a minor axis, wherein the major axis defines a major diameter of the ring and the minor axis defines a minor diameter of the ring;

inserting ring into the subterranean well, the ring positioned in a first orientation that allows the ring to traverse the subterranean well;

delivering the ring to a setting location in the subterranean well, wherein the major diameter of the ring is larger than the inner diameter of the subterranean well at the setting location, and the minor diameter of the ring is smaller than the inner diameter of the subterranean well at the setting location;

positioning the ring in a second orientation that results in the major diameter of the ring engaging the inner circumference of the subterranean well at the setting location and thereby reducing the major diameter of the ring to cause the ring to generally take the shape of the inner circumference of the subterranean well at the setting location to secure the ring in the subterranean well at the setting location.

24. The method of claim 23, wherein the major axis of the ring is generally perpendicular to the minor axis of the ring.

25. The method of claim 23, wherein the outer circumference of the ring is equal to or larger than the inner circumference of the subterranean well at the setting location before substantially deforming to the inner circumference of the subterranean well.

26. The method of claim 23, wherein the wall of the ring includes at least one slot, hole, or gap.

27. The method of claim 26, wherein the at least one slot, hole, or gap extends through the entire wall thickness of the ring.

28. The method of claim 23, wherein the wall of the ring includes at least one void contained within the wall thickness of the ring that does not extend to the outer circumference of the ring or the inner circumference of the ring.

29. The method of claim 23, wherein the outer circumference of the ring includes particles that engage the inner circumference of the subterranean well at the setting location.

30. The method of claim 23, wherein the ring is made out of a material that galvanically corrodes in a subterranean well.

31. The method of claim 23, wherein the ring is made of a material that disintegrates as a result of an interaction with a fluid in a subterranean well.

32. A subterranean well assembly comprising:

a subterranean well having an inner diameter at a setting location and an inner circumference at the setting location;

a ring having an outer circumference, an inner circumference, and a wall having a wall thickness, wherein the ring has a generally oval shape with a major axis and a minor axis, wherein the major axis defines a major diameter of the ring and the minor axis defines a minor diameter of the ring, and the major diameter of the ring is larger than the inner diameter of the subterranean well at the setting location, and the minor diameter of the ring is smaller than the inner diameter of the subterranean well at the setting location, wherein the ring is further configured to substantially deform to the inner circumference of the subterranean well at the setting location by reducing the major diameter of the ring to cause the ring to generally take the shape of the inner circumference of the subterranean well at the setting location to secure the ring in the subterranean well at the setting location.

33. The subterranean well assembly of claim 32, wherein the inner diameter and the inner circumference of the subterranean well at the setting location is defined by casing.

34. The subterranean well assembly of claim 32, wherein at least two points located on the inner circumference of the subterranean well at the setting location are at different distances from a center of the subterranean well.

35. The subterranean well assembly of claim 32, wherein the major axis of the ring is generally perpendicular to the minor axis of the ring.

36. The subterranean well assembly of claim 32, wherein the outer circumference of the ring is equal to or larger than the inner circumference of the subterranean well at the setting location before substantially deforming to the inner circumference of the subterranean well.

37. The subterranean well assembly of claim 32, wherein the wall of the ring includes at least one slot, hole, or gap.

38. The subterranean well assembly of claim 37, wherein the at least one slot, hole, or gap extends through the entire wall thickness of the ring.

39. The subterranean well assembly of claim 32, wherein the wall of the ring includes at least one void contained within the wall thickness of the ring that does not extend to the outer circumference of the ring or the inner circumference of the ring.

40. The subterranean well assembly of claim 32, wherein the outer circumference of the ring includes particles that engage the inner circumference of the subterranean well at the setting location.

41. The subterranean well assembly of claim 32, wherein the ring is made of a material that galvanically corrodes in a subterranean well.

42. The subterranean well assembly of claim 32, wherein the ring is made of a material that disintegrates as a result of an interaction with a fluid in a subterranean well.

43. The subterranean well assembly of claim 32, wherein the subterranean well includes a second inner diameter at a second location, and the second location is adjacent to the setting location, wherein the second inner diameter at the second location is smaller than the inner diameter at the setting location thereby forming a shoulder in the subterranean well at the transition from the second location to the setting location, and at least a portion of the wall thickness of the ring engages the shoulder to further secure the ring in the subterranean well.

* * * * *